US005267811A

United States Patent [19]

Evans

[11] Patent Number: 5,267,811

[45] Date of Patent: Dec. 7, 1993

[54] PORTABLE DOCK FOR WATERCRAFT

[76] Inventor: James T. Evans, 14 S. 4th St., Council Grove, Kans. 66846

[21] Appl. No.: 990,036

[22] Filed: Dec. 14, 1992

[51] Int. Cl.[5] ..... B63C 1/00

[52] U.S. Cl. ..... 405/1; 405/7; 405/218

[58] Field of Search ..... 405/1, 3, 4, 7, 218

[56] References Cited

U.S. PATENT DOCUMENTS

| | | | |
|---|---|---|---|
| 4,155,667 | 5/1979 | Ebsen | 405/7 |
| 4,468,150 | 8/1984 | Price | 405/7 |
| 5,186,576 | 2/1993 | Fournier | 405/7 |

*Primary Examiner*—David H. Corbin
*Attorney, Agent, or Firm*—Daub Legal Services

[57] ABSTRACT

A portable dock consisting of a raised V-Shaped structure, with an essentially rectangularly shaped horizontal base with attached spaced apart angled platforms situated above the base, said dock adapted to reside substantially underwater. The raised V-shaped structure has an open medial channel which enables the platforms to act as cradle members to engage opposite sides of a watercraft, as the watercraft to be docked is maneuvered into the open medial channel bow first. As the watercraft advances from the rear to the front of the dock, along the long axis of the base, the bow rests upon and is elevated by the incline of the platforms. The weight of the watercraft, as it rests upon the platforms, serves to anchor the dock to the bottom of the lake bed, thereby rendering both the watercraft and the dock stationary.

The invention may be easily placed into the body of water and removed therefrom by hand, as it is of such a size and weight so as to allow easy manual transport. The invention enables watercraft such as boats, jet skis, and the like to be "docked" or rendered stationary in shallow water areas along shorelines. This allows the operators of small watercraft greater versatility in their choice of "port" sites, for the securing of the watercraft, and loading and unloading of occupants and or materials from the craft.

2 Claims, 5 Drawing Sheets

PORTABLE DOCK FOR WATERCRAFT

BACKGROUND OF THE INVENTION

I. Field of the Invention

The field of the invention is a dock for small watercraft such as boats and jet skis and the like, and especially for docks that are portable in nature, that may be easily placed into and removed from shallow water areas as desired or needed.

II. Description of the Related Art

Owners of small watercraft know that it is much more convenient and easier to dock the watercraft to a pier or other dock facility, than it is to beach the watercraft at the shore of the lake or other body of water. At a docking facility, means are usually provided to tie the watercraft up and restraints placed on the watercraft keep it from floating away or from being struck by other watercraft. Utilizing a pier type dock, the watercraft may be brought up to the pier and then both ends of the watercraft tied to the pier with a cushioning material such as a rubber tire between the two. Other types of docks may have individual slips for the watercraft and the watercraft need only be tied at its bow end to a holding facility with a rope or other connecting device, the slip providing constructive walkways on each side of the watercraft.

However, problems immediately arise if one is attempting to dock a watercraft at a lake or other body of water not having an established docking facility, or at a point on the lake or other body of water far removed from such an established dock facility. In that event generally the watercraft is beached if possible and if not possible, the watercraft is run up to the shoreline as close as can be accomplished and then the watercraft is tied by means of a rope or other securing means, to a tree, a rock, or some other anchoring device near the edge of the lake. This manner of docking leaves ones watercraft subject to drift and possible damage due to the drift, or damage due to other causes arising when a watercraft is not made secure other than the tieing of the bow.

Prior art discloses there have been dock assemblies available for sportsmen for docking away from recognized docking facilities. Trenka in U.S. Pat. No. 2,930,339 discloses a small boat mooring device wherein a small boat equipped with eyelets on both sides of the stern is moved or backed into position next to the dock. The inventions "U" shaped arms operably attach to the dock and connect with the eyelets on the stern of the small boat. The central portion of the "U" shaped moving device is firmly held to the dock. In addition, steps are provided on the arms for a person stepping from the dock into the stern of the boat.

Viles in U.S. Pat. No. 4,776,726 discloses a boat dock construction of an easily assembled pier type. Additionally, Harris in U.S. Pat. No. 2,774,322 discloses a portable floating dry dock for a seaplane consisting of three sections connected together by struts, one section situated at the front of the plane and partially submerged sections under each wing of the plane.

Dickerson et. al. in U.S. Pat No. 5,067,428 discloses a boat dock consisting of a modified "H" platform adapted to reside substantially underwater, the platform having attached to it two upwardly protruding arms with cradle members attached to engage the opposite sides of the boat to be docked. Lake depths are accounted for by telescoping legs, and various sized boats are accommodated by spreading or narrowing the angle between the upright cradle members.

Pearson in U.S. Pat. No. 3,492,825 discloses a floating, folding portable dock of a size so that it may be conveniently transported and comprising a generally rectangular float, a generally rectangular gang plank of a length substantially equal to said float, and a means hingedly securing the gang plant to said float, along with a portable stabilizer bar with a means for detachably anchoring said stabilizer bar to the ground in order to prevent relative pivotal movement of said gang plank with respect to said float.

Cantrell in U.S. Pat No. 4,107,932 discloses a portable dock consisting primarily of a channel body portion, with a means for being anchored on the bank of a body of water, the body portion being hinged to a ladder, which is elevatable and provided with an anchoring means for embedding into the bed beneath the water level.

U.S. Pat. No. 4,142,477 issued to Powers discloses a portable flat shell floating dock with a tapered front section and a gang plank covered with non-skid material. This dock is designed to be towed by a boat, and attached thereto by an eyebolt. Anchoring rings are also provided in the front of the dock for securing the dock to other stakes driven into the shore.

Dawson in U.S. Pat. No. 4,287,625 discloses a dock comprising a deck structure which floats in water and which provides access to shore and an elongated outrigger which floats in the water and which stabilizes the dock structure.

U.S. Pat. No. 4,505,619 issued to Sargent discloses a portable dock apparatus and a wheeled boat trailer for towing a boat to a body of water and for providing a dock after the boat is launched. The apparatus comprises in combination, a wheeled boat trailer, a main dock ramp having a first end hingedly connected to the rear end of said wheeled boat trailer, and a second end opposite the first end thereof, said hinged connection permitting said main dock ramp to be extended outwardly from the rear end of said wheeled boat trailer in an extended position over the body of water.

While the above devices accomplish the purpose for which they were intended, only the invention disclosed in the Pearson and Powers Patents (Supra) are designed to be so portable, so as to be able to be conveniently manually transported to remote locations. However, the present invention is patentably distinct from Pearson and Powers in that the present invention does not entail a "float" type dock platform, does not have multiple separate parts which must be hinged or cabled, does not have a stake mechanism adapted to secure said dock to the shore line.

It is readily apparent that a portable boat dock which may be easily manually transported, as a single piece unit, and carried in the watercraft to be docked, or carried by a motor vehicle to a desired location would be quite advantageous to a sportsman or a hunter or a fisherman who plans to use his watercraft away from established dock facilities.

SUMMARY OF THE INVENTION

The embodiment of the invention described herein consists essentially of a portable dock for receiving and securing opposite sides of small watercraft in a body of water having a shoreline and a bottom, said portable dock comprising:

A plurality of horizontal base elements operably attached so as to form a generally rectangular horizontal base with a short axis running the width of said generally rectangular horizontal base and a long axis running the length of said generally rectangular horizontal base, a plurality of upwardly protruding oblique and vertical support members operably attached to said generally rectangular horizontal base, a pair of parallel platform supports positioned above and aligned along the long axis of said generally rectangular horizontal base and operably attached to said vertical support members, a pair of parallel platforms resting upon and operably attached to said parallel platform supports, and adapted to reside on opposite sides of the watercraft being secured.

The platforms are parallel to each other, aligned along the long axis of the base, spaced apart and inclined in such a manner so as to be slightly elevated at the "front" end of the dock.

The platforms are also angled with respect to the short axis of the base so as to form an open V-shaped central channel above the generally rectangular horizontal base.

The base elements, support members and platforms supports may be made out of any suitable water resistant and corrosion resistant material, having a sufficient weight so as to render the subject invention non-buoyant. A particularly suitable material is 16 gauge square steel (pipe) and the like. If the platforms are of a metal material, treated lumber, or redwood, they may be covered with any suitable material that will not be abrasive to the hull of the watercraft. Such suitable materials may be rubber, soft polymers, or any carpet-type material such as marine carpet and the like.

The portable dock is placed into the water so that a substantial portion of the subject invention is submerged, with only part of the upwardly rising platforms (the elevated front portions) rising above the water.

The device is easily transportable manually, as it is, when fully constructed, a single piece unit and is of such a size and weight that it may be stored and transported in an automobile storage area, pickup or vans and the like. The dock may even be transported in the very watercraft which will be docked to it.

Accordingly, it is an object of the present invention to provide a single piece lightweight portable dock for small boats and other small watercraft, which may be placed at sites remote from established docking facilities in shallow water areas at or near the shoreline of lakes, ponds or other bodies of water.

It is another object of the subject invention to provide a portable dock which may be manually transported, or carried in the storage area of automobiles, vans, pickups, trucks, or even in the watercraft which is itself to be docked.

These and other objects of the present invention will become apparent from inspection of the disclosure and the claims herein provided.

BRIEF DESCRIPTION OF THE DRAWINGS

For further understanding of the nature and objects of the present invention, reference should be had to the following detailed description taken in connection with the accompanying drawings wherein.

DETAILED DESCRIPTION OF THE PREFERRED EMBODIMENTS

Figure 1:
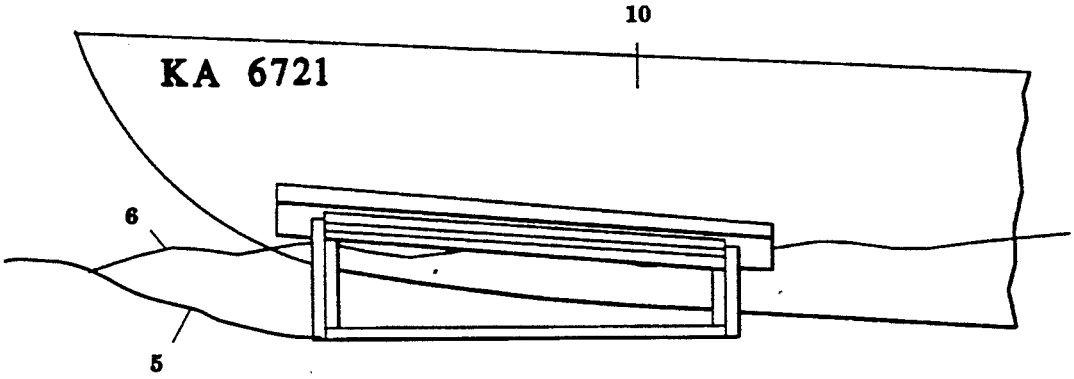
FIG. 1. is a side view of the subject invention docking a boat

Referring now to FIG. 1, a side view of the subject invention, is shown in use docking boat 10 at or near the shoreline 5 of a lake, pond or other body of water. In this side view, the details of the subject invention are shown as if the water 6 were so clear so as to render the parts visible underwater. In FIG. 1, boat 10 is secured and slightly raised at its forward or bow end by being positioned in the open medial channel 7 (not shown in side view) of the subject invention, with the outer hull of boat 10 contacting and resting upon platforms 13 and 14 (14 not showing) adapted to reside on opposite sides of boat 10. Platforms 13 and 14 are the only parts of the subject invention intended to come in actual contact with the boat. The upright stability of the subject invention is maintained by the weight of the subject invention itself, and the weight of boat 10 resting on platforms 13 and 14 of the subject invention.

Figure 2:
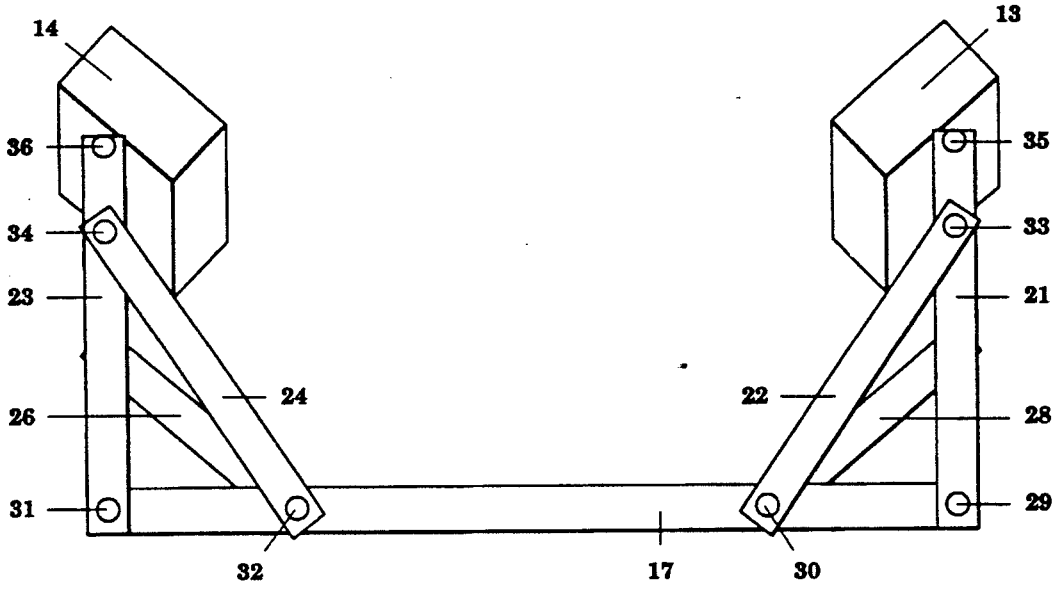
FIG. 2. is a front view of the subject invention

Referring now to FIG. 2, a front view of the invention without the boat and out of water is detailed. Here structural elements of the invention are more clearly seen and additionally the side to side symmetry of the invention is also shown more specifically, and beginning with the lower (base) portion of the invention, base element 17 is operably attached at its endpoints at right angles to base elements 18 and 20, (not shown in front view) at a point not exactly coincident with the front end point of base elements 18 and 20 respectively by anchoring means 45 and 46 respectively (not shown in front view) which pass through transverse holes in base elements 18 and 20 respectively, and seat into the respective endpoints of base element 17. Base element 17 is also operably attached at a points distal its end point to the lower ends of oblique support members 22 and 24 by anchoring means 30 and 32 respectively which are positioned in openings made transversely through the oblique support members and through base member 17. Oblique support members 22 and 24 are operably attached at their upper ends to vertical support members 21 and 23 respectively by anchoring means 33 and 34 respectively, which pass through transverse holes in both the vertical and oblique support members. The lower end of vertical support members 21 and 23 are operably attached at right angles to the forward endpoints of base elements 20 and 18 respectively by anchoring means 29 and 31 respectively, which pass through transverse holes in the vertical support members and seat into the end points of base elements 20 and 18 respectively. The upper ends of vertical support members 21 and 23 are operably attached to front endpoints of platform supports 15 and 16 respectively (not shown in front view) by anchoring means 35 and 36 respectively, which pass through transverse holes in the vertical support members and seat into the front endpoints of platform supports 15 and 16 respectively. Obviously, rear oblique support members 26 and 28 are partially eclipsed in a front view and their operable attachments are complete eclipsed and hence not recited here. Rear vertical support members are completely eclipsed and not recited here. Platforms 13 and 14 respectively are operably attached to platforms supports 15 and 16 respectively (not shown in front view) by anchoring means 8 and 9 respectively at the forward end (not shown in front view) and anchoring means 11 and 12 respectively at the reward end (not shown in front view). supports 15 and 16 are operably attached to platforms 13 and 14 respectively by anchoring means 8 and 9 respectively at the forward end and anchoring means 11 and 12 respectively at the rearward end which pass through transverse holes in the platforms 13 and 14 respectively and platforms supports 15 and 16 respectively.

Figure 3:
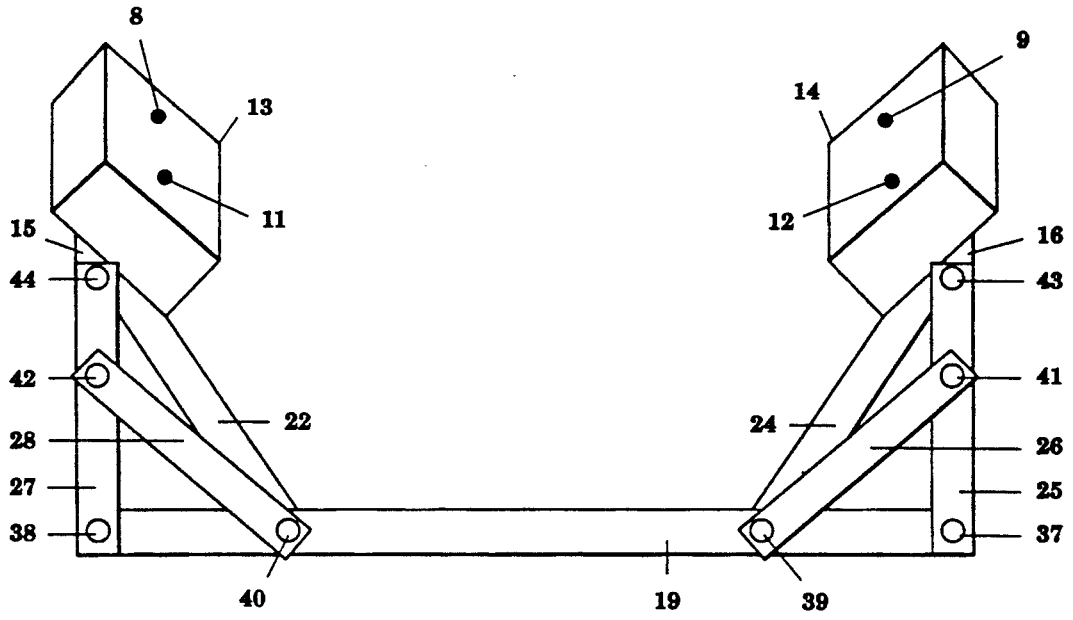
FIG. 3. is a rear view of the subject invention

Referring now to FIG. 3, a rear view of the invention without the boat and out of the water is detailed. Again beginning with the lower (base) portion of the invention, base element 19 is operably attached at a point distal its endpoints to the lower end oblique support member 26 and 28 respectively by anchoring means 39 and 40 respectively which pass through transverse holes in the oblique support members 26 and 28 respectively and base element 19. Base element 19 is also operably attached at right angles at its respective end points to base elements 18 and 20 (not shown in rear view).

Oblique support members 26 and 28 are operably attached at their upper ends to vertical support member 25 and 27 respectively by anchoring means 41 and 42 respectively, which pass through transverse holes in both the vertical and oblique support members. The upper ends of vertical support members 25 and 27 respectively are operably attached to platform supports 16 and 15 respectively (not shown in rear view) by anchoring means 43 and 44 respectively which pass through transverse holes in the vertical support members, and seat into the rear endpoints of platform supports 16 and 15 respectively. The lower ends of vertical support members 25 and 27 respectively are operably attached at right angels to the rear endpoints of base elements 18 and 20 respectively (not shown in rear view) by anchoring means 37 and 38 respectively which pass through transverse holes in the vertical support members 25 and 27 respectively and seat into the rear end points of base elements 18 and 20 respectively (not shown in rear view). Obviously front oblique members 22 and 24 respectively are partially eclipsed in a rear view and their operable attachments are completely eclipsed and hence not located here. Front vertical support members are completely eclipsed and not recited here.

Platforms 13 and 14 respectively are operably attached to platform supports 15 and 16 respectively by anchoring means 8 and 9 respectively at the forward end and anchoring means 11 and 12 at the rearward end.

Figure 4:
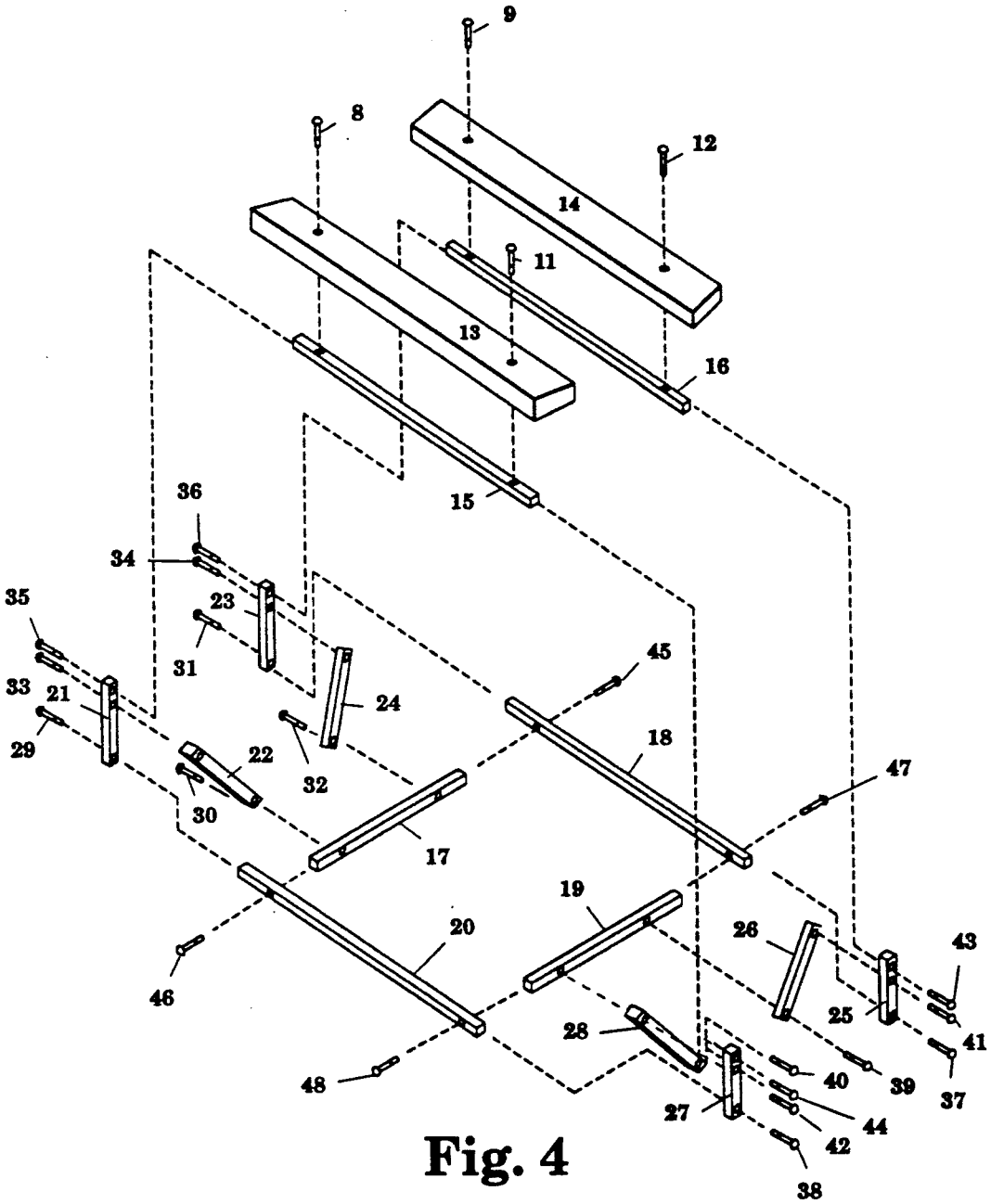
FIG. 4. is an exploded view of the subject invention

Referring now to FIG. 4, an exploded view of the subject invention, without the boat and out of water, is detailed. Here the structural elements of the invention are more clearly seen, and in addition the symmetry of the invention from side to side is illustrated. More specifically, and beginning with the lower (base) portion of the invention, base element 17 is operably attached at its endpoints at right angles to base elements 18 and 20, at a point not exactly coincident with the front end point of base elements 18 and 20 respectively by anchoring means 45 and 46 respectively which pass through transverse holes in base elements 18 and 20 respectively, and seat into the respective endpoints of base element 17. Base element 17 is also operably attached at a point distal its end points to the lower ends of oblique support members 22 and 24 by anchoring means 30 and 32 respectively which are positioned in openings made transversely through the oblique support members and through base member 17. Oblique support members 22 and 24 are operably attached at their upper ends to vertical support members 21 and 23 respectively by anchoring means 33 and 34 respectively, which pass through transverse holes in both the vertical and oblique support members. The lower end of vertical support members 21 and 23 are operably attached at right angles to the forward endpoints of base elements 20 and 18 respectively by anchoring means 29 and 31 respectively, which pass through transverse holes in the vertical support members and seat into the end points of base elements 20 and 18 respectively. The upper ends of vertical support members 21 and 23 are operably attached to the front end-points of platform supports 15 and 16 respectively by anchoring means 35 and 36 respectively, which pass through transverse holes in the vertical support members and seat into the front endpoints of platform supports 15 and 16 respectively. Obviously, rear oblique support members 26 and 28 are partially eclipsed in a front view and their operable attachments are complete eclipsed and hence not recited here. Rear vertical support members are completely eclipsed and not recited here. Platforms 13 and 14 respectively are operably attached to platforms supports 15 and 16 respectively (not shown in front view) by anchoring means 8 and 9 respectively at the forward end (not shown in front view) and anchoring means 11 and 12 respectively at the reaward end. Platform supports 15 and 16 are operably attached to platforms 13 and 14 respectively by anchoring means 8 and 9 respectively at the forward end and anchoring means 11 and 12 respectively at the rearward end which pass through transverse holes in the platforms 13 and 14 respectively and platforms supports 15 and 16 respectively.

Again, beginning with the lower (base) portion of the invention, base element 19 is operably attached at a point distal its endpoints to oblique support member 26 and 28 respectively by anchoring means 39 and 40 respectively which pass through transverse holes in the oblique support members 26 and 28 respectively and base element 19. Base element 19 is also operably attached at right angles at its respective end points to base elements 18 and 20 by anchoring means 47 and 48 respectively, which pass through transverse holes in base elements 18 and 20 respectively, that are positioned in base elements 18 and 20 respectively at a point not exactly coincident with their rear end-points. Anchoring means 47 and 48 seat into the end-points of base element 19.

Oblique support members 26 and 28 are operably attached at their upper ends to vertical support member 25 and 27 respectively by anchoring means 41 and 42 respectively, which pass through transverse holes in both the vertical and oblique support members. The upper ends of vertical support members 25 and 27 respectively are operably attached to platform supports 16 and 15 respectively by anchoring means 43 and 44 respectively which pass through transverse holes in the vertical support members, and seat into the rear endpoints of platform supports 16 and 15 respectively. The lower ends of vertical support members 25 and 27 respectively are operably attached at right angles to the rear endpoints of base elements 18 and 20 respectively by anchoring means 37 and 38 respectively which pass through transverse holes in the vertical support members 25 and 27 respectively and seat into the rear end points of base elements 18 and 20 respectively.

Figure 5:
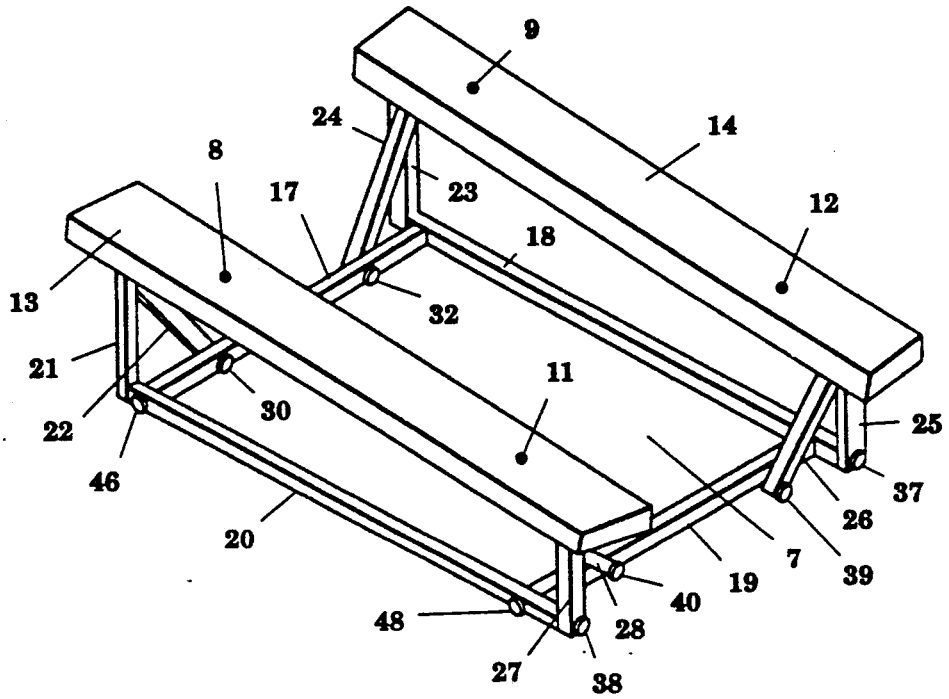
FIG. 5. is a perspective view of the subject invention

Referring now to FIG. 5, a perspective view from above and from the rear of the subject invention, without the boat and out of water is detailed. Although the individual components that are visible in this view, are again denoted by numbering, since that numbering is consistent with the numbering in FIG. 1 through FIG. 4 where the inventive apparatus has been detailed at great length, their interaction will not, for the sake of eliminating redundancy, be again herein recited.

Changes may be made in the combination and arrangement of parts or elements as heretofore set forth in the specification and shown in the drawings without departing from the spirit and scope of the invention as defined in the following claims.

I claim:

1. A portable dock for docking watercraft in the shallow areas along the shoreline of a body of water, said portable dock comprising:

a plurality of horizontal base elements operably attached so as to form a generally rectangular horizontal base with a short axis running the width of said generally rectangular horizontal base and a long axis running the length of said generally rectangular horizontal base, a plurality of upwardly protruding oblique and vertical support members operably attached to said generally rectangular horizontal base, a pair of parallel platform supports positioned above and aligned along the long axis of said generally rectangular horizontal base and operably attached to said vertical support members, a pair of parallel platforms resting upon and operably attached to said parallel platform supports, and adapted to reside on opposite sides of the watercraft being docked, said oblique support members being operably attached proximate their lower ends to said horizontal base elements forming said short axis of said generally rectangular horizontal base coincident with the front and rear of said dock proximate the ends of said horizontal base elements at points proximate the four corners of said generally rectangular horizontal base and operably attached proximate their upper ends to said vertical support members, said oblique support members coincident with the front of said dock being elongated in relation to the oblique support members similarly positioned at the rear of said dock, said vertical support members being operably attached proximate their lower ends to said horizontal base elements forming said long axis of said generally rectangular horizontal base coincident with the sides of said dock at points proximate the four corners of said generally rectangular horizontal base coincident with the front and rear of said dock and operably attached proximate their upper ends proximate to the ends of said platform supports, said vertical support members coincident with the front of said dock being elongated in relation to the vertical support members similarly positioned at the rear of said dock, said pair of parallel platform supports forming a pair of spaced apart, angled, forwardly inclined platform supports, said parallel platforms operably attached to said spaced apart, angled, forwardly inclined platform supports, so as to form an open V-shaped central channel above the generally rectangular horizontal base, said V-shaped central channel running with the long axis of the generally rectangular horizontal base.

2. The portable dock as defined in claim 1 in which said horizontal base elements forming said generally rectangular horizontal base, said vertical and oblique support members and said parallel platform supports comprise 16 gauge steel tubing and said parallel platforms comprise redwood.

* * * * *